US008496454B2

(12) United States Patent
Wallis et al.

(10) Patent No.: US 8,496,454 B2
(45) Date of Patent: Jul. 30, 2013

(54) UNLOADER SYSTEM AND METHOD FOR A COMPRESSOR

(71) Applicant: Emerson Climate Technologies, Inc., Sidney, OH (US)

(72) Inventors: Frank S. Wallis, Sidney, OH (US); Ernest R. Bergman, Rossburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 13/672,902

(22) Filed: Nov. 9, 2012

(65) Prior Publication Data

US 2013/0064690 A1 Mar. 14, 2013

Related U.S. Application Data

(63) Continuation of application No. 12/694,488, filed on Jan. 27, 2010, now Pat. No. 8,308,455.

(60) Provisional application No. 61/147,661, filed on Jan. 27, 2009.

(51) Int. Cl.

| | |
|---|---|
| ***F04B 49/00*** | (2006.01) |
| ***F04B 39/10*** | (2006.01) |
| ***F16K 31/122*** | (2006.01) |

(52) U.S. Cl.

USPC ..... 417/440; 417/446; 417/507; 137/512.3; 137/494

(58) Field of Classification Search

USPC ..... 417/296, 306, 440, 441, 446, 507; 137/512.1, 523, 506, 629, 494, 512.3, 516.11, 137/516.25

See application file for complete search history.

(56) References Cited

U.S. PATENT DOCUMENTS

| | | | | | |
|---|---|---|---|---|---|
| 1,652,978 | A | * | 12/1927 | Enock | 417/569 |
| 1,950,575 | A | * | 3/1934 | Smolensky | 137/512.1 |
| 2,703,102 | A | * | 3/1955 | Neugebauer | 137/493.8 |
| 2,704,035 | A | * | 3/1955 | Bader | 417/504 |
| 3,310,069 | A | * | 3/1967 | Hoffman | 137/630.19 |
| 4,043,710 | A | * | 8/1977 | Bunn et al. | 417/440 |
| 4,445,824 | A | * | 5/1984 | Bunn et al. | 417/440 |
| 4,447,193 | A | * | 5/1984 | Bunn et al. | 417/441 |
| 4,737,080 | A | * | 4/1988 | Owsley et al. | 417/275 |
| 5,331,998 | A | * | 7/1994 | Sperry | 137/512.1 |
| 5,642,753 | A | * | 7/1997 | Thistle et al. | 137/512.1 |
| 5,695,325 | A | * | 12/1997 | Sperry | 417/53 |
| 6,361,288 | B1 | * | 3/2002 | Sperry | 417/307 |
| 2001/0039966 | A1 | * | 11/2001 | Walpole et al. | 137/512.1 |

* cited by examiner

*Primary Examiner* — Charles Freay
*Assistant Examiner* — Nathan Zollinger
(74) *Attorney, Agent, or Firm* — Harness, Dickey & Pierce, P.L.C.

(57) ABSTRACT

An apparatus is provided and may include a compression mechanism, a valve plate having a plurality of ports, a header, and a plurality of cylinders disposed within the header. A plurality of pistons may be respectively disposed in the plurality of cylinders and may be movable between a first position separated from the valve plate and permitting flow through the plurality of ports and into the compression mechanism and a second position engaging the valve plate and restricting flow through the plurality of ports and into the compression mechanism. A chamber may be disposed within each of the cylinders and may receive a pressurized fluid in a first mode to move the piston into the second position and may vent the pressurized fluid in a second mode to move the piston into the first position. One of the chambers may include a different diameter than the other of the chambers.

20 Claims, 13 Drawing Sheets

UNLOADER SYSTEM AND METHOD FOR A COMPRESSOR

CROSS-REFERENCE TO RELATED APPLICATIONS

This application is a continuation of U.S. patent application Ser. No. 12/694,488 filed on Jan. 27, 2010, which claims the benefit of U.S. Provisional Application No. 61/147,661, filed on Jan. 27, 2009. The entire disclosure of the above application is incorporated herein by reference.

FIELD

The present disclosure relates generally to compressors and more particularly to a capacity modulation system and method for a compressor.

BACKGROUND

Heat pump and refrigeration systems are commonly operated under a wide range of loading conditions due to changing environmental conditions. In order to effectively and efficiently accomplish a desired cooling and/or heating under these changing conditions, conventional heat pump or refrigeration systems may incorporate a compressor having a capacity modulation system that adjusts an output of the compressor based on the environmental conditions.

SUMMARY

This section provides a general summary of the disclosure, and is not a comprehensive disclosure of its full scope or all of its features.

An apparatus is provided and may include a compression mechanism, a valve plate associated with the compression mechanism and having a plurality of ports in fluid communication with the compression mechanism, a header disposed adjacent to the valve plate, and a plurality of cylinders disposed within the header. A plurality of pistons may be respectively disposed in the plurality of cylinders and may be movable between a first position separated from the valve plate and permitting flow through the plurality of ports and into the compression mechanism and a second position engaging the valve plate and restricting flow through the plurality of ports and into the compression mechanism. A chamber may be disposed within each of the cylinders and may receive a pressurized fluid in a first mode to move the piston into the second position and may vent the pressurized fluid in a second mode to move the piston into the first position. One of the chambers may include a different diameter than the other of the chambers.

A method is provided and may include opening a plurality of ports of a valve plate when a plurality of pistons are in a raised position to permit flow through the plurality of ports. Fluid may be evacuated at a different rate from at least one of a plurality of chambers to permit one of the plurality of pistons to move into the raised position before the other of the plurality of pistons. The plurality of pistons may be moved within and relative to respective ones of the plurality of chambers from a lowered position to the raised position in response to evacuation of the fluid.

In another configuration, a method is provided and may include opening a plurality of ports of a valve plate when a plurality of pistons are in a raised position to permit flow through the plurality of ports. A reduced volume of fluid may be evacuated from at least one of a plurality of chambers to permit one of the plurality of pistons to move into the raised position before the other of the plurality of pistons. The plurality of pistons may be moved within and relative to respective ones of the plurality of chambers from a lowered position to the raised position in response to evacuation of the fluid.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
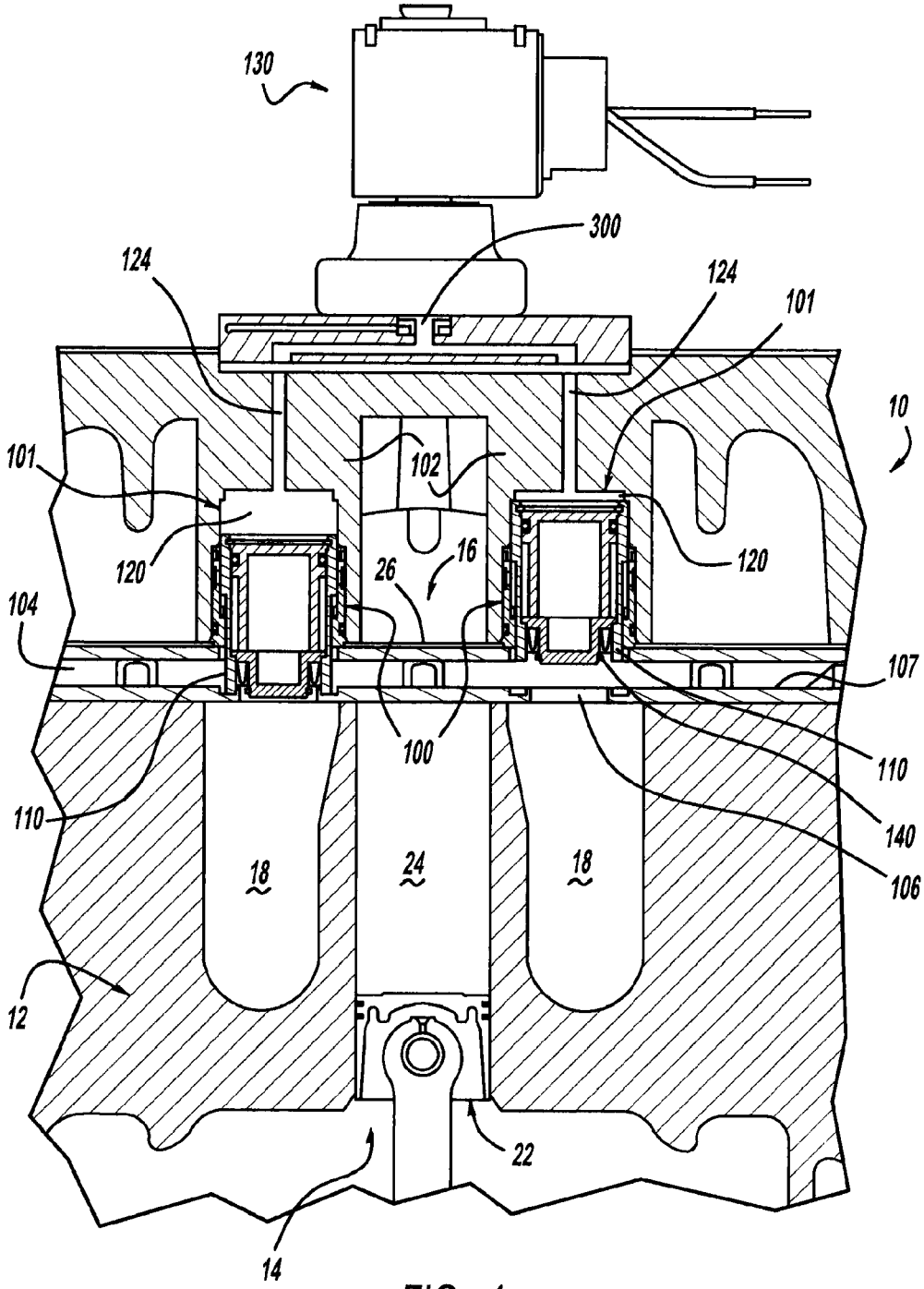
FIG. 1 is a partial sectional view of a compressor in combination with a valve apparatus according to the present disclosure.

The following description is merely exemplary in nature and is not intended to limit the present disclosure, application, or uses. It should be understood that throughout the drawings, corresponding reference numerals indicate like or corresponding parts and features. The present teachings are suitable for incorporation in many different types of scroll and rotary compressors, including hermetic machines, open drive machines and non-hermetic machines.

Various embodiments of a valve apparatus are disclosed that allow or prohibit fluid flow, and may be used to modulate fluid flow to a compressor, for example. The valve apparatus may include one or more cylinders defining a chamber having a piston slidably disposed therein, and a control-pressure passage in communication with the chamber. The chamber area may be varied to reduce or increase piston travel and/or a control pressure passage may be employed to vary fluid flow. A control pressure communicated to the chamber biases the piston for moving the piston relative to a valve opening, to thereby allow or prohibit fluid communication through the valve opening.

When pressurized fluid is communicated to the chamber, the piston is biased to move against the valve opening, and may be used for blocking fluid flow to a suction inlet of a compressor, for example. The valve apparatus may be a separate component that is spaced apart from but fluidly coupled to an inlet of a compressor or, alternatively, may be a component included within a compressor assembly. The valve apparatus may be operated together with a compressor, for example, as an independent unit that may be controlled by communication of a control pressure via an external flow control device. The valve apparatus may also optionally include a pressure-responsive valve member and a solenoid valve, to selectively provide for communication of a control pressure fluid to the control pressure passage.

Referring to FIG. 1, a compressor 10 with a pressure-responsive valve apparatus or unloader valve 100 is shown including a cylinder 101 defining a chamber 120 having a piston assembly 110 disposed therein, which moves relative to an opening 106 in a valve plate 107 to control fluid flow therethrough. The piston 110 may be moved by communication of a control pressure to the chamber 120 in which the piston 110 is disposed. The compressor 10 may include a plurality of pistons 110 (shown in FIG. 1 raised and lowered for illustration purposes only). The control pressure may be communicated to the chamber 120 by a valve, for example. To selectively provide a control pressure, the valve apparatus 100 may optionally include a pressure-responsive valve member and a solenoid valve, which will be described later.

Compressor 10 is shown in FIG. 1 and may include a manifold 12, a compression mechanism 14, and a discharge assembly 16. The manifold 12 may be disposed in close proximity to the valve plate 107 and may include at least one suction chamber 18. The compression mechanism 14 may similarly be disposed within the manifold 12 and may include at least one piston 22 received generally within a cylinder 24 formed in the manifold 12. The discharge assembly 16 may be disposed at an outlet of the cylinder 24 and may include a discharge-valve 26 that controls a flow of discharge-pressure gas from the cylinder 24.

The capacity of the compressor 10 may be regulated by selectively opening and closing one or more of the plurality of pistons 110 to control flow through the valve plate 107. A predetermined number of pistons 110 may be used, for example, to selectively block the flow of suction gas to the cylinder 24.

It is recognized that one or more pistons 110 forming a bank of valve cylinders may be modulated together or independently, or one or more banks may not be modulated while others are modulated. The plurality of banks may be controlled by a single solenoid valve with a manifold, or each bank of valve cylinders may be controlled by its own solenoid valve. The modulation method may include duty-cycle modulation that, for example, provides an ON-time that ranges from zero to one hundred percent relative to an OFF-time, where fluid flow may be blocked for a predetermined OFF-time period. Additionally, the modulation method used may be digital (i.e., duty-cycle modulation), conventional blocked suction, or a combination thereof. The benefit of using a combination may be economic. For example, a full range of capacity modulation in a multi-bank compressor may be provided by using conventional blocked suction in all but one bank and the above-described digital modulation unloader piston configuration in the remaining bank of cylinders.

Figure 2:
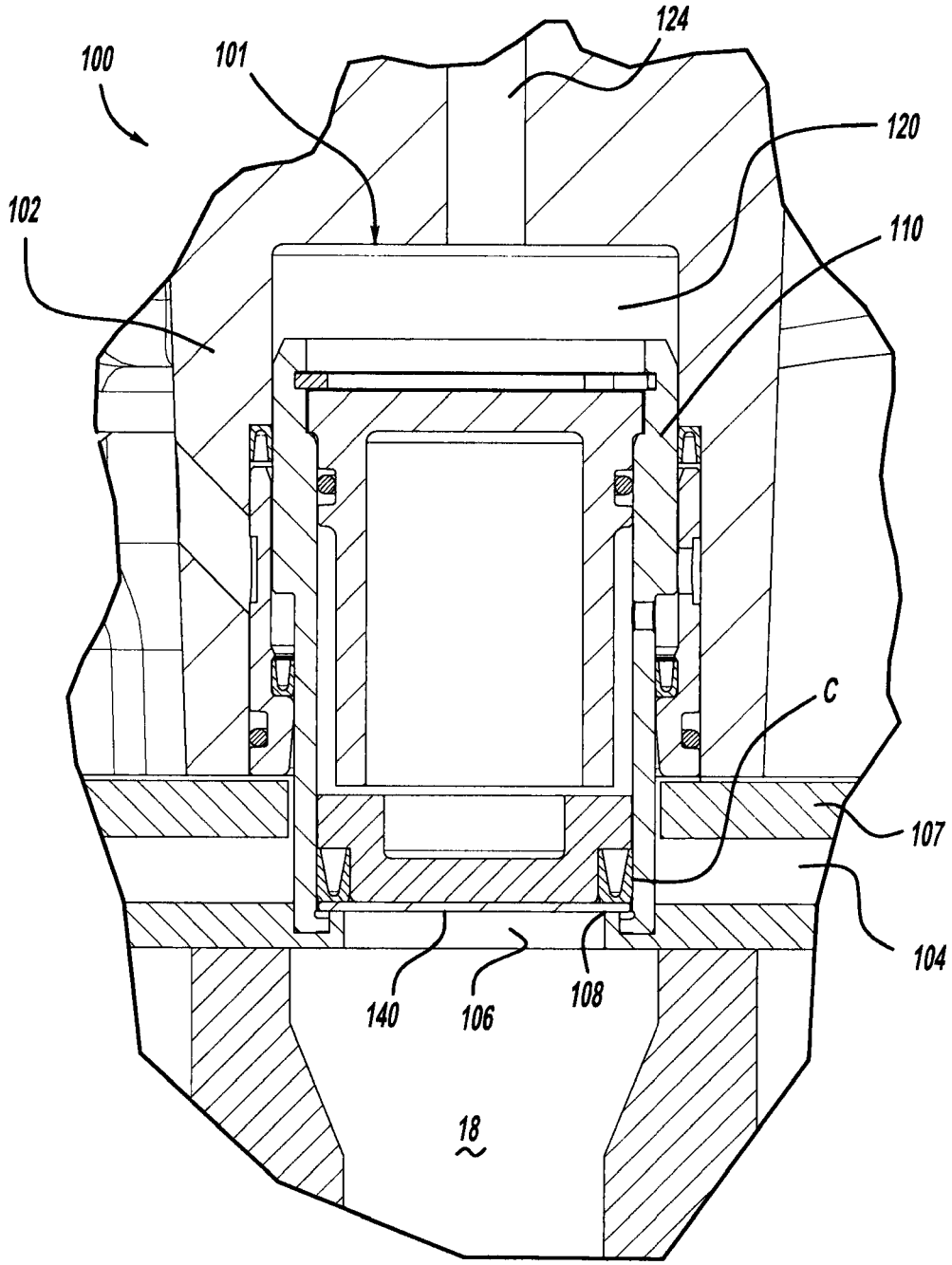
FIG. 2 is a partial sectional view of a valve apparatus of the present disclosure shown in a closed position.

As shown in FIGS. 1 and 2, the piston 110 is capable of prohibiting fluid flow through the valve apparatus 100, and may be used for blocking fluid flow to a passage 104 in communication with the suction inlet of a compressor 10. While the valve apparatus 100 will be described hereinafter as being associated with a compressor 10, the valve apparatus 100 could also be associated with a pump, or used in other applications to control fluid flow.

The chamber 120 is formed in a body 102 of the valve apparatus 100 and slidably receives the piston 110 therein. The valve plate 107 may include a passage 104 formed therein, which is in selective communication with the valve opening 106. The passage 104 of the valve apparatus 100 may provide for communication of fluid to an inlet of the compressor 10, for example. The body 102 may include a control-pressure passage 124, which is in communication with the chamber 120. A control pressure may be communicated via the control-pressure passage 124 to chamber 120, to move the piston 110 relative to the valve opening 106. The body 102 may be positioned relative to the compression mechanism 14 such that the valve plate 107 is disposed generally between the compression mechanism 14 and the body 102 (FIG. 1).

Figure 3:
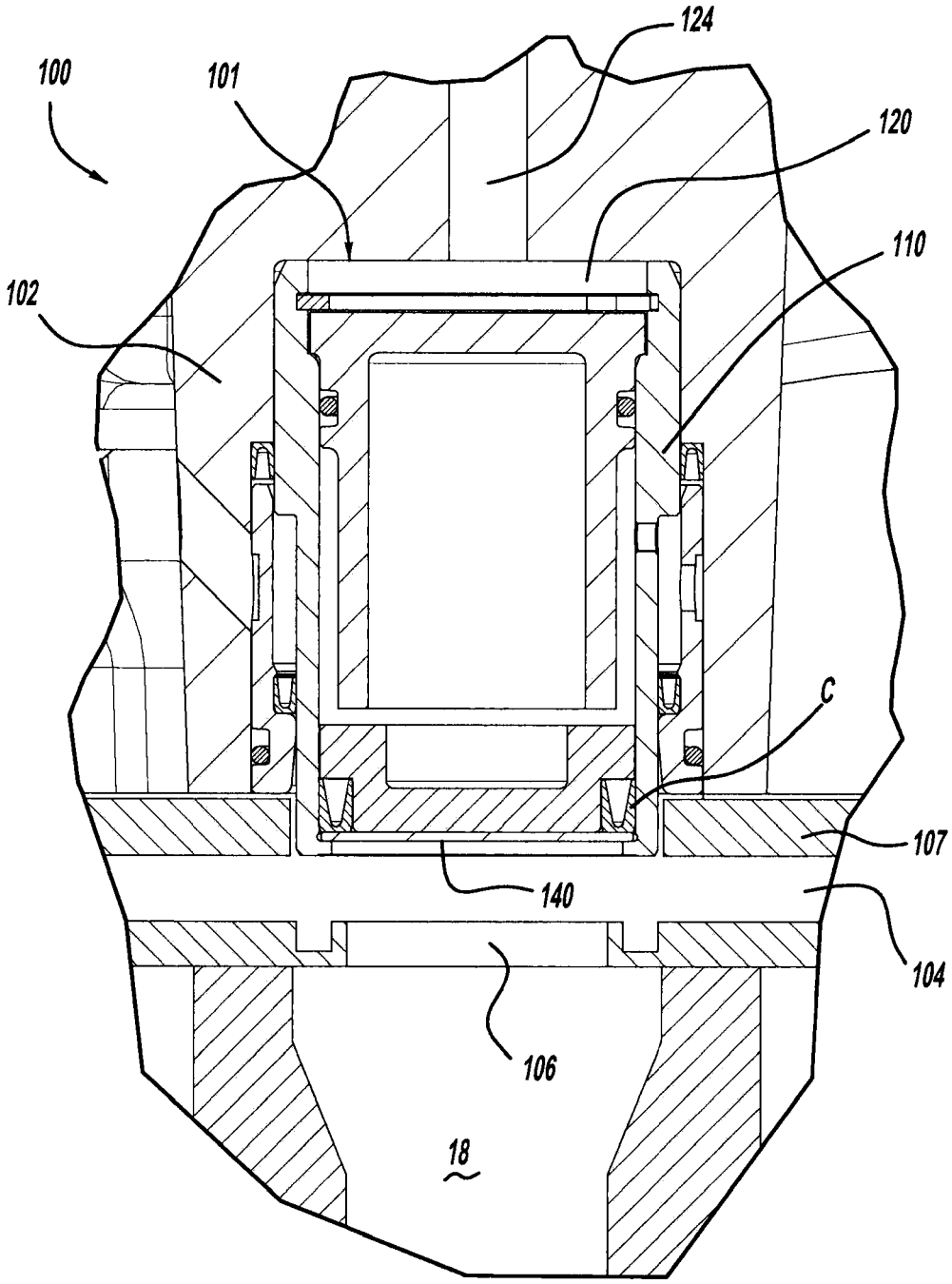
FIG. 3 is a partial sectional view of the valve apparatus of FIG. 2 shown in an open position.

FIGS. 2 and 3 illustrate valve apparatus 100 with piston 110 in lowered and raised positions, respectively. When a pressurized fluid is communicated to the chamber 120, the piston 110 moves against valve opening 106 to prohibit fluid flow therethrough (FIG. 2). In an application where the piston 110 blocks fluid flow to a suction inlet of a compressor 10 for "unloading" the compressor, the piston 110 may be referred to as an "unloader" piston. In such a compressor application, the pressurized fluid may be provided by the discharge-pressure gas of the compressor 10. Discharge-pressure gas may then be vented from the chamber 120, to bias the piston 110 away from the valve opening 106 (FIG. 3). Accordingly, the piston 110 is movable relative to the valve opening 106 to allow or prohibit fluid communication to passage 104.

With continued reference to FIG. 1, the piston 110 is moved by application of a control pressure to a chamber 120 in which the piston 110 is disposed. The volume within opening 106, generally beneath the piston 110, is at low pressure or suction pressure, and may be in communication with a suction-pressure gas of a compressor, for example. When the chamber 120 above the piston 110 is at a higher relative pressure than the area under the piston 110, the relative pressure difference causes the piston 110 to be urged in a downward direction within the chamber 120.

The piston 110 may further include a disc-shaped sealing element 140 disposed at an open end of the piston 110. Blocking fluid flow through the opening 106 is achieved when a valve seat 108 at opening 106 is engaged by the disc-shaped sealing element 140 disposed on the lower end of the piston 110.

When discharge-pressure gas is communicated to the chamber 120, the force of the discharge-pressure gas acting on the top of the piston 110 causes the piston 110 and sealing element 140 to move towards the raised valve seat 108 adjacent the valve opening 106 (FIG. 2). The high pressure gas disposed above the piston 110 and low-pressure gas disposed under the piston 110 (i.e., in the area proximate the valve seat 108) causes the piston 110 to move toward the valve plate 107. The disc-shaped sealing element 140 is held down against the valve opening 106 by the discharge-pressure gas applied on top of the disc-shaped sealing element 140. Suction-pressure gas is also disposed under the sealing element 140 at the annulus between the seal C and valve seat 108.

Figure 4:
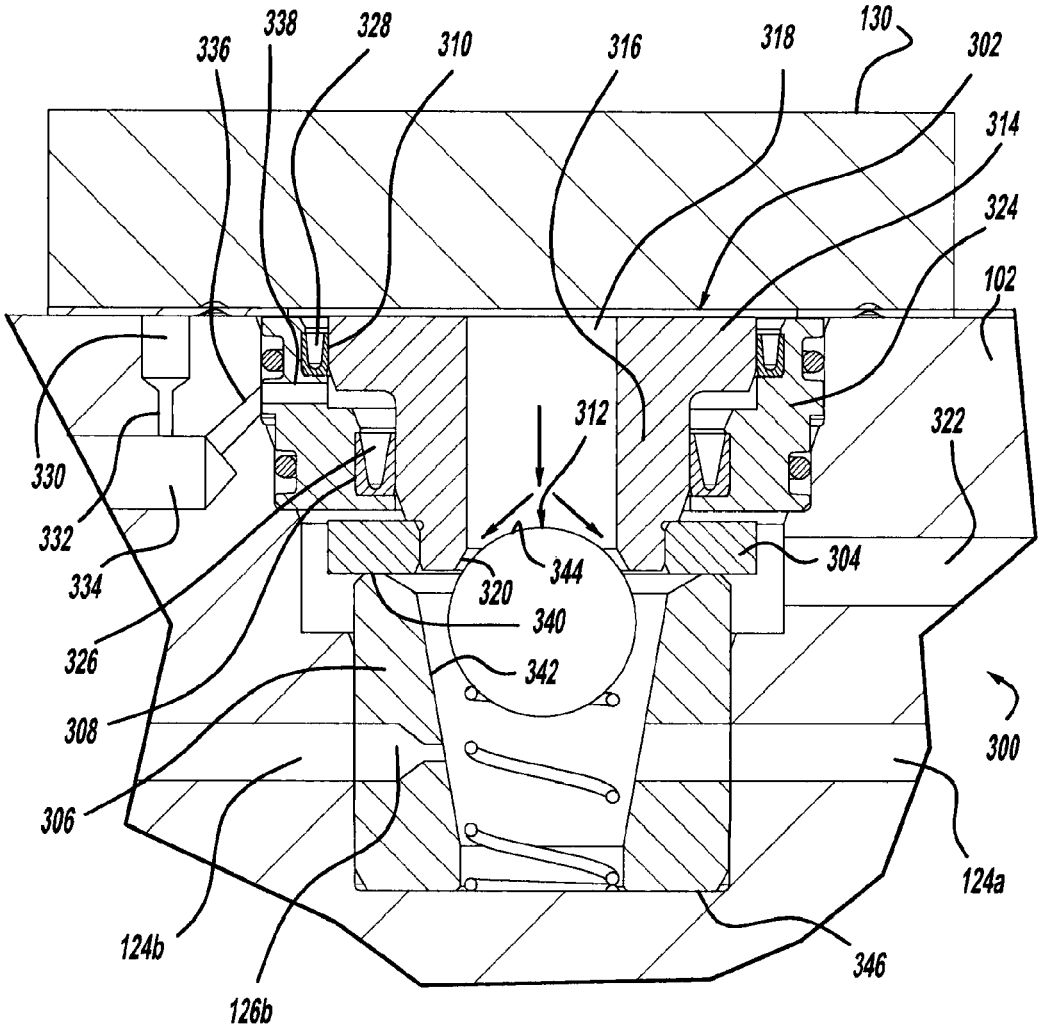
FIG. 4 is a cross-sectional view of a pressure-responsive valve according to the present disclosure shown in a first position.
Figure 5:
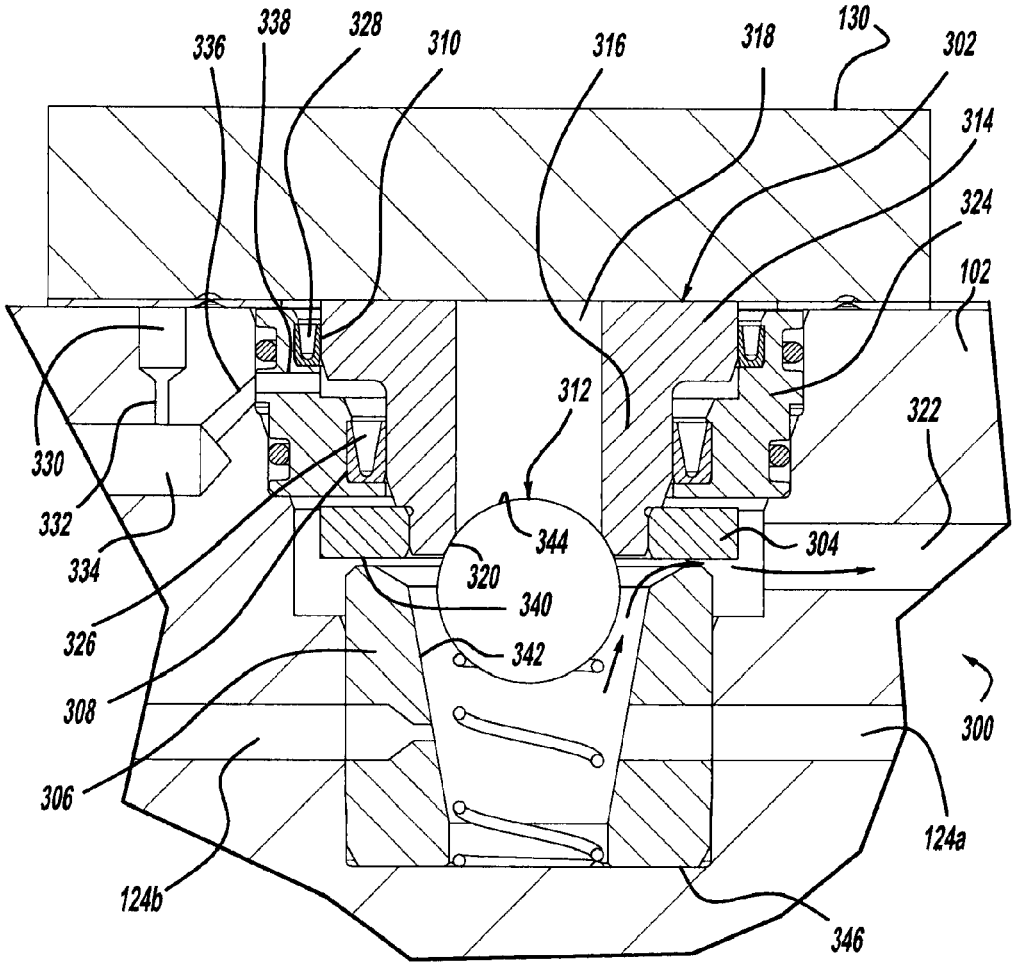
FIG. 5 is a cross-sectional view of the pressure-responsive valve of FIG. 4 shown in a second position.

Referring to FIGS. 4 and 5, a pressure-responsive valve 300 is provided and may include a first-valve member 302, a second-valve member 304, a valve-seat member 306, an intermediate-isolation seal 308, an upper seal 310, and a check valve 312. The pressure-responsive valve 300 is movable in response to a solenoid valve 130 being energized and de-energized to facilitate movement of the piston 110 between the unloaded and loaded positions.

The solenoid valve 130 is in communication with a pressurized fluid. The pressurized fluid may be a discharge pressure gas from the compressor 10, for example. The solenoid valve 130 is movable to allow or prohibit communication of pressurized fluid to the pressure responsive valve member 300. The solenoid valve 130 functions as a two-port (on/off) valve for establishing and discontinuing communication of discharge-pressure gas to the valve 300. In connection with the pressure-responsive valve member 300, the solenoid valve 130 substantially has the output functionality of a three-port solenoid valve (i.e., suction-pressure gas or discharge-pressure gas may be directed to the control-pressure passage 124 to raise or lower the piston 110). When the solenoid valve 130 is energized to an open position, the solenoid valve 130 establishes communication of discharge-pressure gas to the valve 300.

The first-valve member 302 may include an upper-flange portion 314, a longitudinally extending portion 316 extending downward from the upper-flange portion 314, and a longitudinally extending passage 318. The passage 318 may extend completely through the first-valve member 302 and may include a flared check valve seat 320.

The second-valve member 304 may be an annular disk disposed around the longitudinally extending portion 316 of the first valve member 302 and may be fixedly attached to the first-valve member 302. While the first and second valve members 302, 304 are described and shown as separate components, the first and second valve members 302, 304 could alternatively be integrally formed. The first and second valve members 302, 304 (collectively referred to as the "slave piston") are slidable within the body 102 between a first position (FIG. 4) and a second position (FIG. 5) to prohibit and allow, respectively, fluid communication between the control-pressure passage 124 (FIG. 3) and a vacuum port 322.

The intermediate-isolation seal 308 and the upper seal 310 may be fixedly retained in a seal-holder member 324, which, in turn, is fixed within the body 102. The intermediate-isolation seal 308 may be disposed around the longitudinally extending portion 316 of the first-valve member 302 (i.e., below the upper-flange portion 314) and may include a generally U-shaped cross section. An intermediate-pressure cavity 326 may be formed between the U-Shaped cross section of the intermediate-isolation seal 308 and the upper-flange portion 314 of the first-valve member 302.

The upper seal 310 may be disposed around the upper-flange portion 314 and may also include a generally U-shaped cross section that forms an upper cavity 328 beneath the base of the solenoid valve 130. The upper cavity 328 may be in fluid communication with a pressure reservoir or discharge-gas reservoir 330 formed in the body 102. The discharge-gas reservoir 330 may include a vent orifice 332 in fluid communication with a suction-pressure port 334. The suction-pressure port 334 may be in fluid communication with a source of suction gas such as, for example, a suction inlet of a compressor. Feed drillings or passageways 336, 338 may be formed in the body 102 and seal-holder member 324, respectively, to facilitate fluid communication between the suction-pressure port 334 and the intermediate-pressure cavity 326 to continuously maintain the intermediate-pressure cavity 326 at suction pressure. Suction pressure may be any pressure that is less than discharge pressure and greater than a vacuum pressure of the vacuum port 322. Vacuum pressure, for purposes of the present disclosure, may be a pressure that is lower than suction pressure and does not need to be a pure vacuum.

The valve-seat member 306 may be fixed within the body 102 and may include a seat surface 340 and an annular passage 342. In the first position (FIG. 4), the second-valve member 304 is in contact with the seat surface 340, thereby forming a seal therebetween and prohibiting communication between the control-pressure passage 124 and the vacuum port 322. In the second position (FIG. 5), the second-valve member 304 disengages the seat surface 340 to allow fluid communication between the control-pressure passage 124 and the vacuum port 322.

The check valve 312 may include a ball 344 in contact with a spring 346 and may extend through the annular passage 342 of the valve-seat member 306. The ball 344 may selectively engage the check valve seat 320 of the first-valve member 302 to prohibit communication of discharge gas between the solenoid valve 130 and the control-pressure passage 124.

With continued reference to FIGS. 4 and 5, operation of the pressure-responsive valve 300 will be described in detail. The pressure-responsive valve 300 is selectively movable between a first position (FIG. 4) and a second position (FIG. 5). The pressure-responsive valve 300 may move into the first position in response to discharge gas being released by the solenoid valve 130. Specifically, as discharge gas flows from the solenoid valve 130 and applies a force to the top of the upper-flange portion 314 of the first-valve member 302, the valve members 302, 304 are moved into a downward position, as shown in FIG. 4. Forcing the valve members 302, 304 into the downward position seals the second-valve member 304 against the seat surface 340 to prohibit fluid communication between the vacuum port 322 and the control-pressure passage 124.

The discharge gas accumulates in the upper cavity 328 formed by the upper seal 310 and in the discharge-gas reservoir 330, where it is allowed to bleed into the suction-pressure port 334 and through the vent orifice 332. While the suction-pressure port 334 is in fluid communication with suction chamber 18, the vent orifice 332 has a sufficiently small diameter to allow the discharge-gas reservoir 330 to remain substantially at discharge pressure while the solenoid valve 130 is energized.

A portion of the discharge gas is allowed to flow through the longitudinally extending passage 318 and urge the ball 344 of the check valve 312 downward, thereby creating a path for the discharge gas to flow through to the control-pressure passage 124 (FIG. 4). In this manner, the discharge gas is allowed to flow from the solenoid valve 130 and into the chamber 120 to urge the piston 110 downward into the unloaded position and prevent communication of suction-pressure gas into the cylinder 24.

To return the piston 110 to the upward (or loaded) position, the solenoid valve 130 may be de-energized, thereby prohibiting the flow of discharge gas therefrom. The discharge gas may continue to bleed out of the discharge-gas reservoir 330 through the vent orifice 332 and into the suction-pressure port 334 until the longitudinally extending passage 318, the upper cavity 328, and the discharge-gas reservoir 330 substantially reach suction pressure. At this point, there is no longer a net downward force urging the second-valve member 304 against the seat surface 340 of the valve-seat member 306. The spring 346 of the check valve 312 is thereafter allowed to bias the ball 344 into sealed engagement with check valve seat 320, thereby prohibiting fluid communication between the control-pressure passage 124 and the longitudinally extending passage 318.

As described above, the intermediate-pressure cavity 326 is continuously supplied with fluid at suction pressure (i.e., intermediate pressure), thereby creating a pressure differential between the vacuum port 322 (at vacuum pressure) and the intermediate-pressure cavity 326 (at intermediate pressure). The pressure differential between the intermediate-pressure cavity 326 and the vacuum port 322 applies a force on valve members 302, 304 and urges the valve members 302, 304 upward relative to the body 102. Sufficient upward movement of the valve members 302, 304 relative to the body 102 allows fluid communication between the chamber 120 and the vacuum port 322. Placing chamber 120 in fluid communication with the vacuum port 322 allows the discharge gas occupying chamber 120 to evacuate through the vacuum port 322 to passage 104 of valve plate 107.

The evacuating discharge gas flowing from chamber 120 to vacuum port 322 (FIG. 5) may assist the upward biasing force acting on the valve members 302, 304 by the intermediate-pressure cavity 326. The upward biasing force of the check valve 312 against the check valve seat 320 may further assist the upward movement of the valve members 302, 304 due to engagement between the ball 344 of the check valve 312 and the valve seat 320 of the first-valve member 302. Once the chamber 120 vents back to suction pressure, the piston 110 is allowed to slide upward to the loaded position, thereby allowing flow of suction-pressure gas into the cylinder 24 from the suction chamber 18 and increasing the capacity of the compressor.

In a condition where a compressor is started with discharge and suction pressures being substantially balanced and the piston 110 is in the unloaded position, the pressure differential between the intermediate-pressure cavity 326 and the vacuum port 322 provides a net upward force on the valve members 302, 304, thereby facilitating fluid communication between the chamber 120 and the vacuum port 322. The vacuum pressure of the vacuum port 322 will draw the piston 110 upward into the loaded position, even if the pressure differential between the intermediate-pressure cavity 326 and the area upstream of 182 (FIG. 1) is insufficient to force the piston 110 upward into the loaded position. This facilitates moving the piston 110 out of the unloaded position and into the loaded position at a start-up condition where discharge and suction pressures are substantially balanced.

The above valve apparatus is generally of the type described in Assignee's U.S. application Ser. No. 12/177,528, the disclosure of which is incorporated herein by reference.

Figure 6:
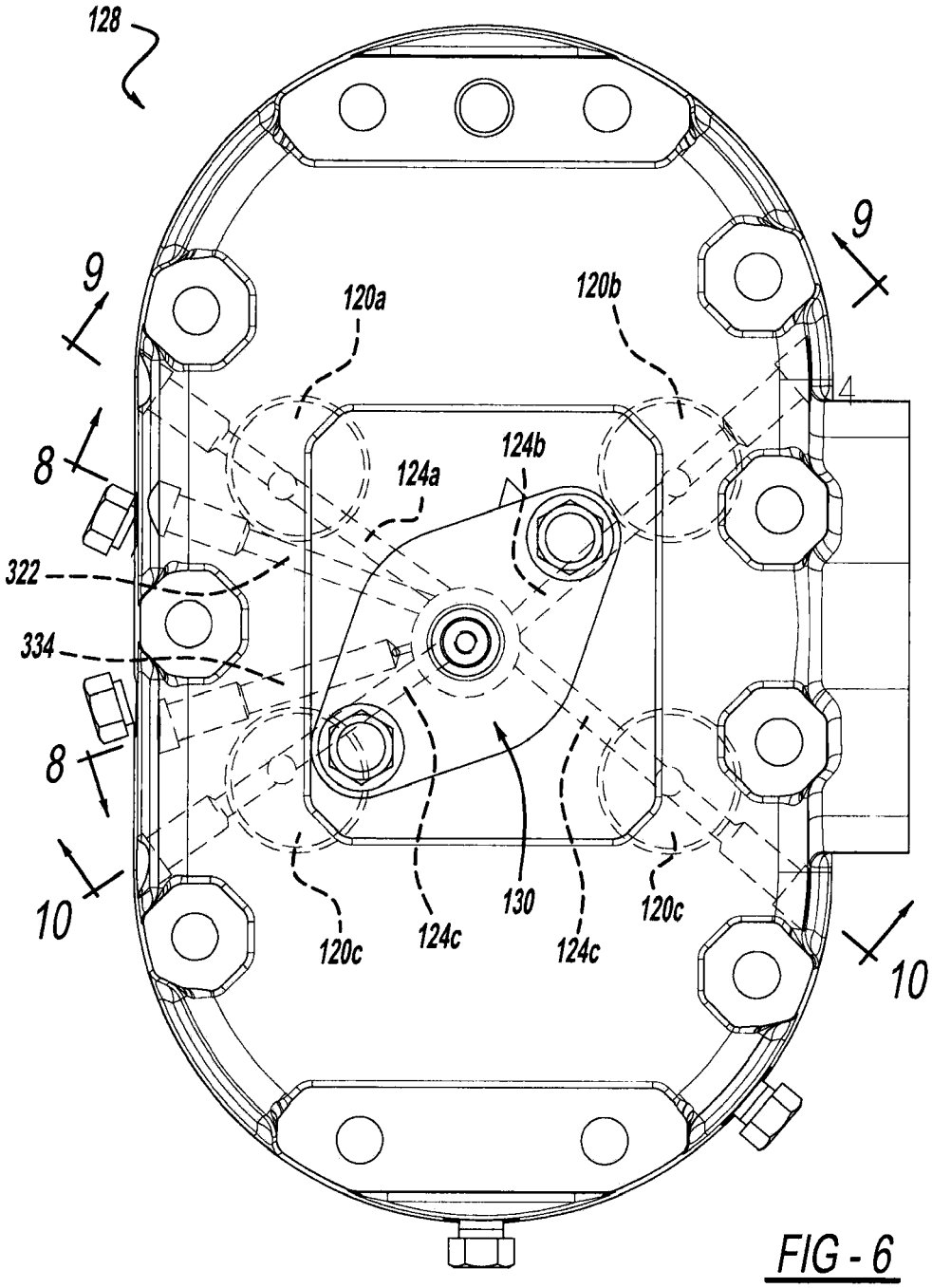
FIG. 6 is a top view of a header of a compressor according to the present disclosure.
Figure 7:
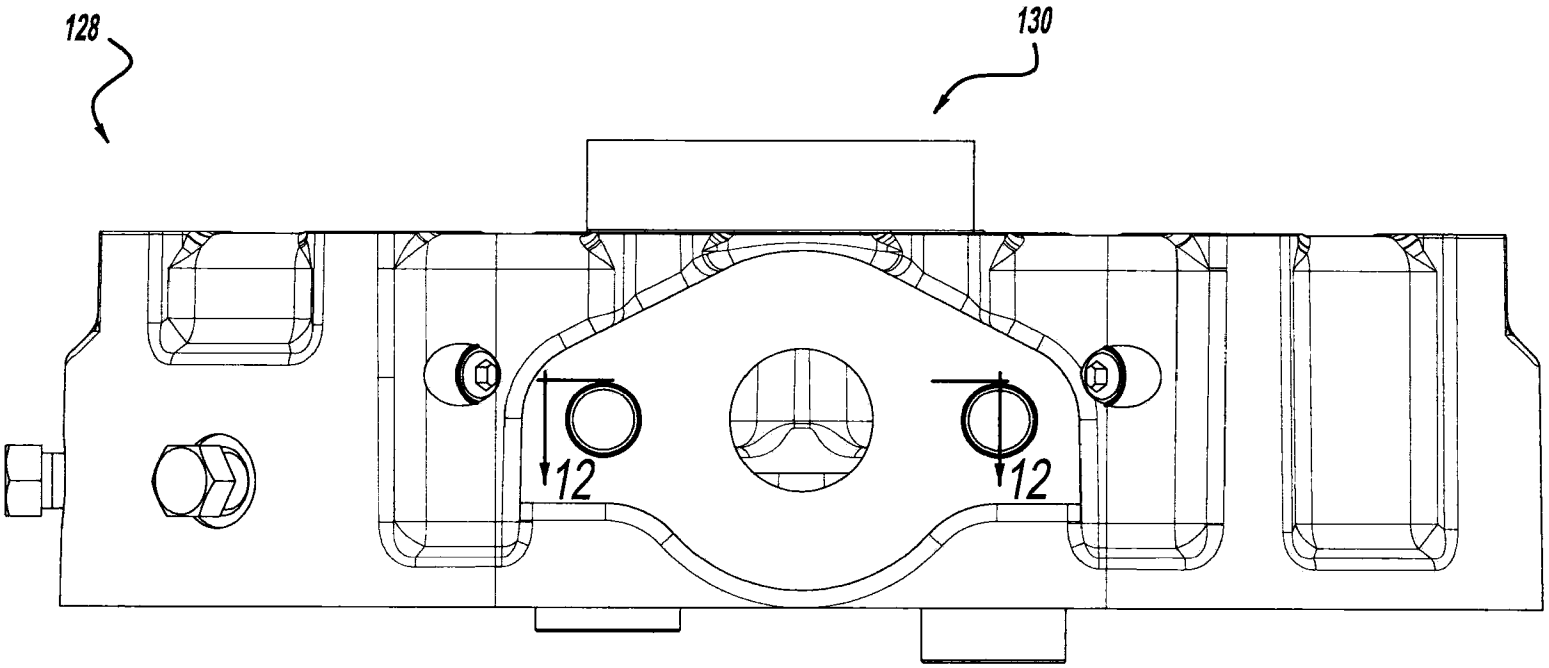
FIG. 7 is a side view of the header of FIG. 6.
Figure 8:
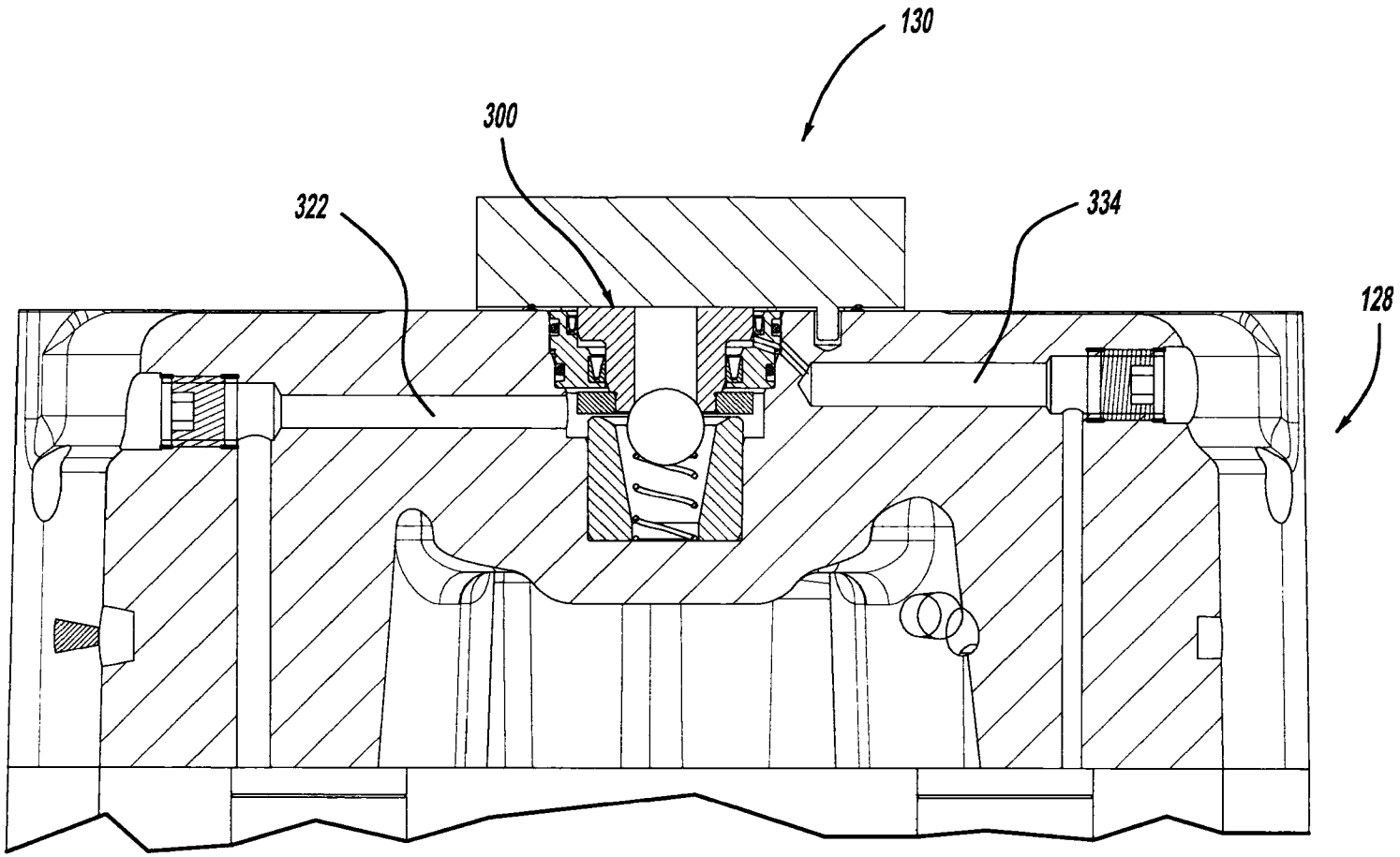
FIG. 8 is a cross-sectional view of the header of FIG. 6 taken along line 8-8.

With reference to FIGS. 6 and 7, a header 128 of compressor 10 is illustrated. Header 128 includes pistons 110*a*, 110*b*, and 110*c*, chambers 120*a*, 120*b*, and 120*c* respectively in fluid communication with control-pressure passages 124*a*, 124*b*, and 124*c* and respectively receiving pistons 110*a*, 110*b*, and 110*c*, and the pressure-responsive valve 300, which cooperate to control the timing of the opening of each respective valve apparatus 100.

With reference to FIGS. 8-12, the mass flow rate into the passage 104 of the valve plate 107 may be controlled with the incorporation a control element such as a chamber 120*a* having a reduced volume when compared to the other chambers 120*b*, 120*c* and/or reduced orifices 126*b* and 126*c* associated with control-pressure passages 124*b* and 124*c*, respectively. As high pressure gas is communicated to the control-pressure passages 124*a*, 124*b*, and 124*c* and into the chambers 120*a*, 120*b*, and 120*c*, the pistons 110*a*, 110*b*, and 110*c* are biased into the lowered or unloaded position. As pressurized gas is vented from the chambers 120*a*, 120*b*, and 120*c*, the pistons 110*a*, 110*b*, and 110*c* raise and transition into the loaded position, which may allow a rapid inrush of gas into the previously evacuated valve plate 107. Raising multiple valves 100 simultaneously may create excessive mass flow rate due to the inrush of gas into the passage 104 of the valve plate 107. By intentionally staging the valves 100 to open at varied times, the mass flow rate into the passage 104 of the valve plate 107 may be controlled. The valves 100 may be staged using a control element such as the chamber 120*a* and/or the reduced orifices 126*b*, 126*c*.

Figure 11:
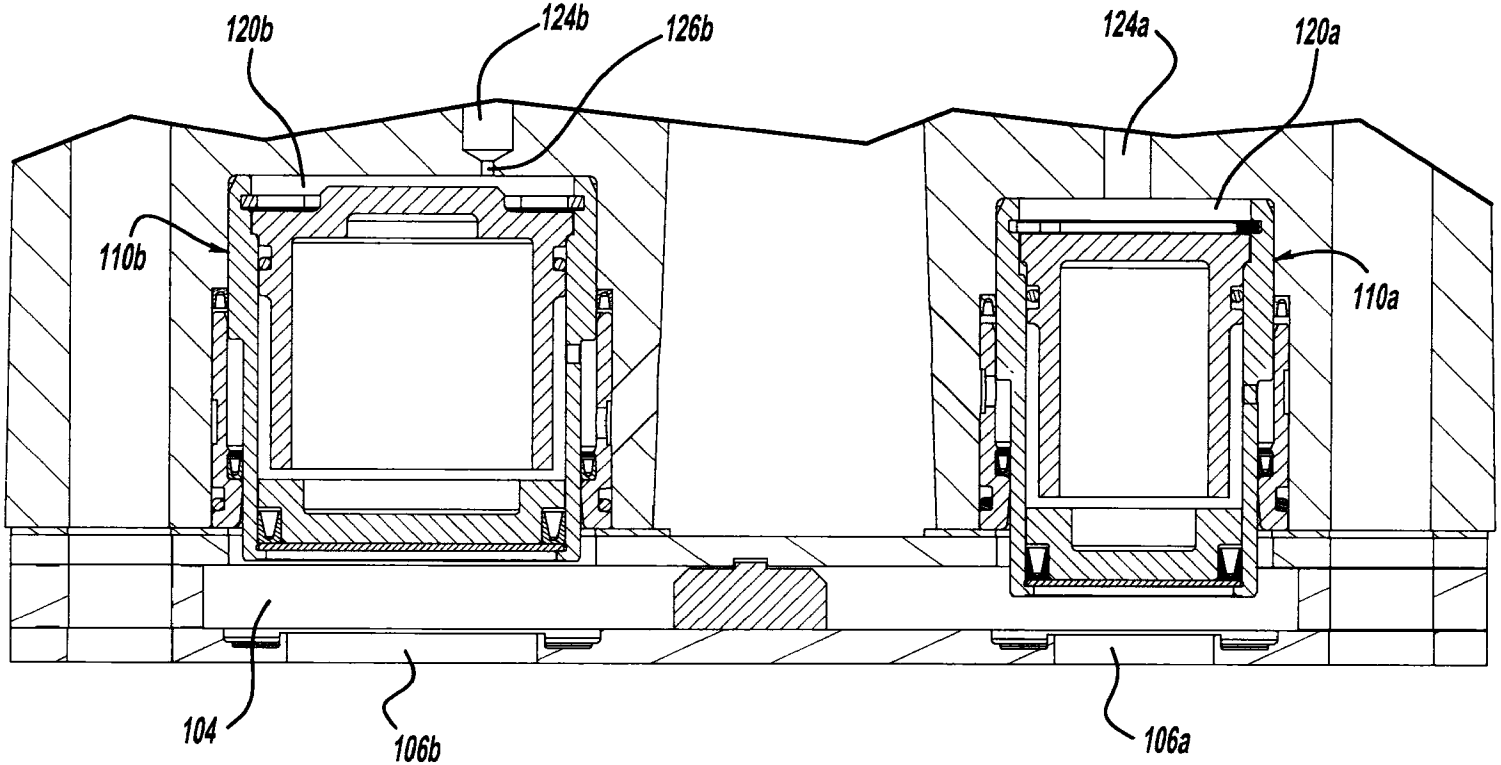
FIG. 11 is a cross-sectional view of the header showing a pair of valves having pistons of varying diameter.
Figure 12:
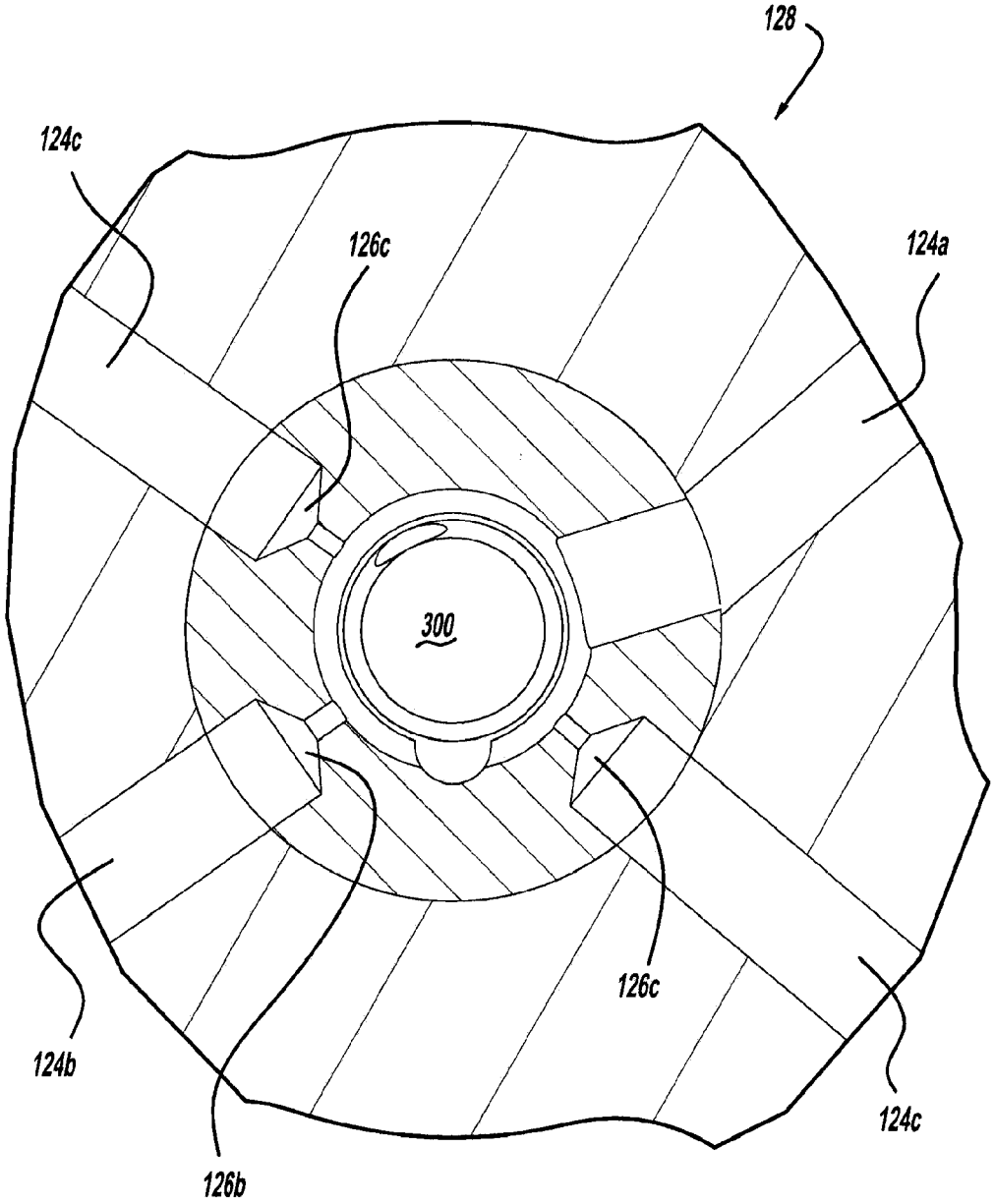
FIG. 12 is a top cross-sectional view of the header of FIG. 7 taken along line 12-12.

The volume of the chamber 120*a* may be smaller than the chambers 120*b*, 120*c* by reducing the travel of the piston 110*a* within the chamber 120*a* (FIG. 9) and/or by reducing a diameter of the piston 110*a* and, thus, the diameter of the chamber 120*a* (FIG. 11). In either scenario, reducing the volume of the chamber 120*a* reduces the volume of gas that must be communicated to or from the chamber 120*a* to cause movement of the piston 110*a* relative to the chamber 120*a* between the lowered (i.e., unloaded) position and the raised (i.e., loaded) position.

Figure 9:
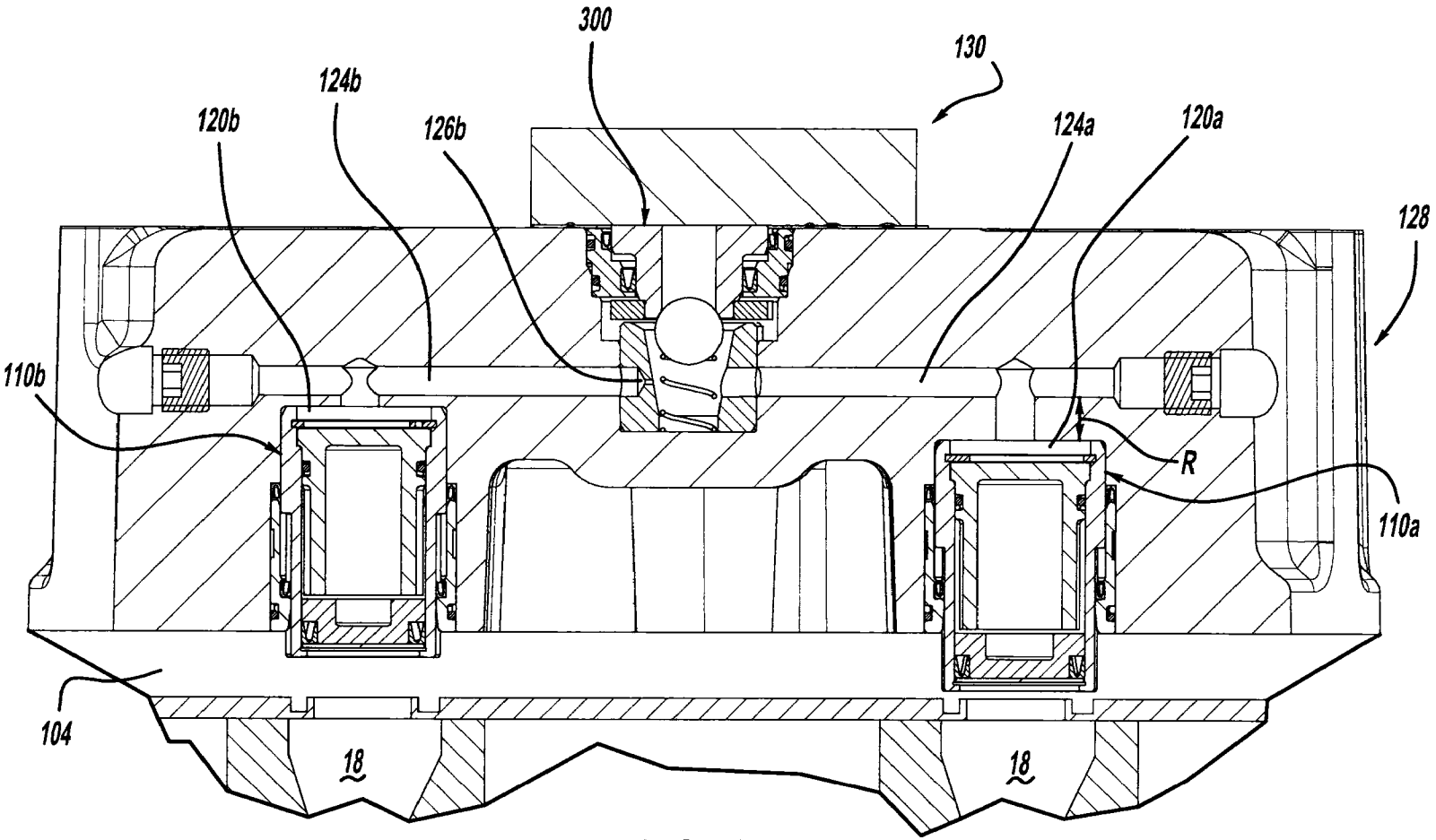
FIG. 9 is a cross-sectional view of the header of FIG. 6 taken along line 9-9.

With further reference to FIG. 9, the header 128 may include a lead piston 110*a* and a secondary piston 110*b*. The lead piston 110*a* may be disposed within a chamber 120*a* having a smaller volume than the chamber 120*b* associated with the piston 110*b*. The reduced volume of the chamber 120*a* may be accomplished by reducing the travel of the piston 110*a* within the chamber 120*a*, which may be represented by distance R. As previously described in FIG. 1, the piston 110 may be moved by communication of a control pressure from the control pressure-passage 124 to the chamber 120, thereby moving the piston 110 relative the opening 106 of the valve plate 107 to control fluid flow therethrough.

The reduced volume of chamber 120*a* of the lead piston 110*a* may be in fluid communication with the control-pressure passage 124*a* and the previously described valve member 300. Because the reduced volume of chamber 120*a* has a smaller volume than the chamber 120*b*, less fluid is required to move the lead piston 110*a* into the unloaded position (FIG. 2) and less fluid needs to be evacuated from the chamber 120*a* to transition the lead piston 110*a* into the loaded position (FIG. 3) when compared to the volume of fluid required to load and unload the piston 110*b*. Therefore, the lead piston 110*a* will be the first piston to open or close due to the smaller volume of chamber 120*a*.

The secondary piston 110*b* may be located proximate to the lead piston 110*a* and may include the chamber 120*b* in fluid connection with the control-pressure passage 124*b*. The control-pressure passage 124*b* may be fluidly connected to the previously described valve member 300 and may include the reduced orifice 126*b*. By reducing the flow rate of pressurized gas into and out of the chamber 120*b*, the reduced orifice 126*b* operates to delay the transition of the secondary piston 110*b* between the loaded and unloaded positions. Orifice size may be varied depending on the desired delay between loaded and unloaded positions of the secondary piston 110*b*.

Figure 10:
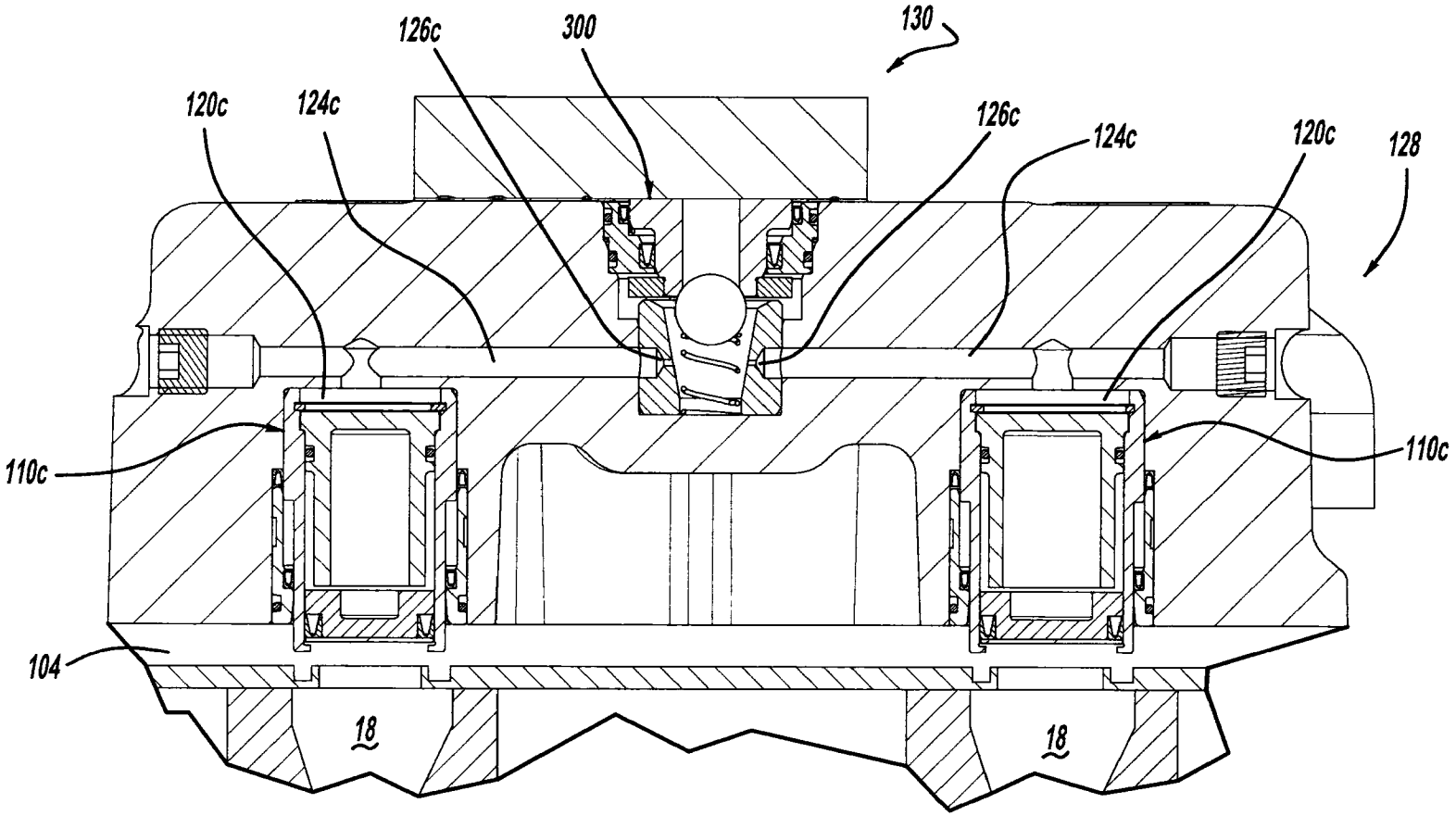
FIG. 10 is a cross-sectional view of the header of FIG. 6 taken along line 10-10.

With reference to FIG. 10, the header 128 may include one or more third pistons 110*c*. The third pistons 110*c* may include the chambers 120*c* in fluid communication with the control-pressure passages 124*c*. The control-pressure passages 124*c* may be fluidly connected to the valve member 300 and may include a reduced orifice 126*c*. The reduced orifice 126*c* may be a different size than that of the reduced orifice 126*b* of the passage 124*b*. In certain aspects, the reduced orifice 126*c* may be smaller than the reduced orifice 126*b*, thus reducing the flow rate of pressurized fluid between the valve member 300 and the chambers 120*c* more than the reduction in flow rate in the passages 124*b*. Therefore, the delay between loaded and unloaded positions of the third pistons 110*c* would be greater than the delay for the secondary piston 110*b*. The lead piston 110*a* and control chamber 120*a* could likewise be associated with a reduced orifice (not shown) provided the other features of the piston 110*a* and chamber 120*a* allow the lead piston 110*a* to move into the loaded position in advance of the pistons 110*b*, 110*c*. In other aspects, the diameter of the control-pressure passages 124*a*, 124*b*, 124*c* may be varied to further restrict the flow of pressurized gas to and from the chambers 120*a*, 120*b*, 120*c*.

In addition to the foregoing, the valve opening 106 of the valve plate 107 may be varied in size to further prevent the inrush of gas when the pistons 110*a*, 110*b*, 110*c* are moved into the raised or loaded position. For example, a valve opening 106 having a large opening will allow a greater flow rate of gas through the valve opening 106 when the pistons 110*a*, 110*b*, 110*c* move from the unloaded position to the loaded position when compared to a valve opening 106 having a smaller opening. In one configuration, a valve opening 106*a* (FIG. 11) associated with the lead piston 110*a* is smaller than the valve opening 106*b* associated with the second piston 110*b*. The smaller valve opening 106*a* prevents a large inrush of gas into the suction chamber 18 when the lead piston 110*a* is moved into the loaded position before the second piston 110*b* is moved into the loaded position.

With reference to FIGS. 9-12, operation of the compressor 10 will be described in detail. The pressure responsive valve member 300 may be in fluid communication with the control-pressure passages 124*a*, 124*b*, and 124*c* and the chambers 120*a*, 120*b*, and 120*c*, respectively. The chamber 120*a* may have a reduced volume when compared to the other chambers 120*b*, 120*c*. The reduced volume of the chamber 120*a* may be accomplished by reducing the travel of the piston 110*a* within the chamber 120*a* such that the piston 110*a* is required to travel a shorter distance between the loaded position and the unloaded position when compared to the pistons 110*b*, 110*c*.

The passage 124*b* may have a reduced orifice 126*b* disposed proximate to the valve member 300 to restrict fluid flow to the chamber 120*b* and control the rate of movement of the piston 110*b* during the loaded to unloaded transition and vice versa. Similarly, the passages 124*c* may have reduced orifices 126*c* disposed proximate to the valve member 300 that are smaller or larger than the reduced orifice 126*b* to restrict fluid flow to the chamber 120*c* at a rate different from that to the chamber 120*b*, thus establishing a transition time for the piston 110*c* that is different than the piston 110*b*. The reduced orifices 126*b*, 126*c* could alternatively be disposed proximate to the chambers 120*b*, 120*c* (FIG. 11).

The chambers 120*a*, 120*b*, and 120*c* may initially include the lead piston 110*a*, the secondary piston 110*b* and one or more third pistons 110*c*, respectively, all in a raised or loaded position. The solenoid 130 may communicate discharge pressure gas into the passages 124*a*, 124*b*, and 124*c* via the valve member 300. Because the passage 124*a* is unrestricted, the gas will be communicated therethrough to the chamber 120*a* with the highest mass flow rate. Because the chamber 120*a* includes a smaller volume than chambers 120*b*, 120*c*, less gas is required to move the lead piston 110*a* to the down or unloaded position when compared to the chambers 120*b*, 120*c*. Therefore, the lead piston 110*a* will seat into the opening 106 in the valve plate 107 before the pistons 110*b*, 110*c*, and prevent fluid flow to the passage 104.

The lead piston 110*a* could alternatively or additionally include a reduced diameter in addition to a reduced travel, thereby causing the chamber 120*a* to have a reduced diameter. As shown in FIG. 11, reducing the diameter of the chamber 120*a* allows the piston 110*a* to be raised and lowered faster than the piston 110*b* having a greater diameter, as the volume of gas that must be evacuated from or communicated to the control chamber 120*a* associated with the piston 110*a* is reduced.

As described above, the reduced orifices 126*c* may include a smaller size than the reduced orifice 126*b*. Due to the relative size of orifice 126*c*, the valve 300 will deliver a higher flow rate of discharge gas through the control-pressure passage 124*b* and into the chamber 120*b*. The chambers 120*b* and 120*c* may have the same volume, thus the increased flow rate to the chamber 120*b* will transition the piston 110*b* from the loaded position to the unloaded position before the pistons 110*c*. After the piston 110*b* is seated into the opening 106 following seating of the lead piston 110*a*, the smallest flow rate of gas delivered through the passages 124*c* and into the chambers 120*c* transitions the pistons 110*c* into the unloaded position; seated in the opening 106.

The transition from the unloaded position to the loaded position operates in a similar fashion. The solenoid 130 may be de-energized or energized to prevent communication of discharge gas to the valve member 300. Energizing or de-energizing solenoid 130 causes the valve 300 to vent discharge gas out common exhaust port 322. Discharge gas may flow from the chambers 120*a*, 120*b*, and 120*c* through passages 124*a*, 124*b*, and 124*c* to the valve 300 and out exhaust port 322. The lead piston 110*a* may move to the raised position first due to the reduced volume in chamber 120*a* and unrestricted passage 124*a*. As described above, the reduced volume of chamber 120*a* may be accomplished by shortening a travel of the lead piston 110*a* and/or by reducing a diameter of the lead piston 110*a* and the chamber 120*a*.

The secondary piston 110*b* may be raised following the piston 110*a* and before the pistons 110*c* due to the larger restricted orifice 126*b* in the passage 124*b*. Finally, the third pistons 110*c* may be raised to the loaded position due to the smallest flow rate of discharge gas moving to the exhaust port 322. The cycle may then be repeated.

In the above described aspect, the pistons 110*a*, 110*b*, and 110*c* open in sequence. By staggering the operation of the multiple valve apparatuses 100, the flow rate of pressurized gas flowing through the passage 104 of valve plate 107 may be better controlled and improve compressor performance and efficiency. It should be noted that the compressor 10 and valve apparatus 100 may comprise combinations of one or more of the above components or features, such as the solenoid assembly 130, which may be separate from or integral with the compressor 10.

The above described combination of a reduced volume chamber and reduced orifices is merely exemplary and the present disclosure is not limited to such a configuration. Any number of pistons with reduced-volume piston chambers, reduced orifices, reduced valve openings, or the inclusion of a reduced control-pressure passage diameter to stage opening of each piston 110*a*, 110*b*, 110*c* may be employed.

Figure 13:
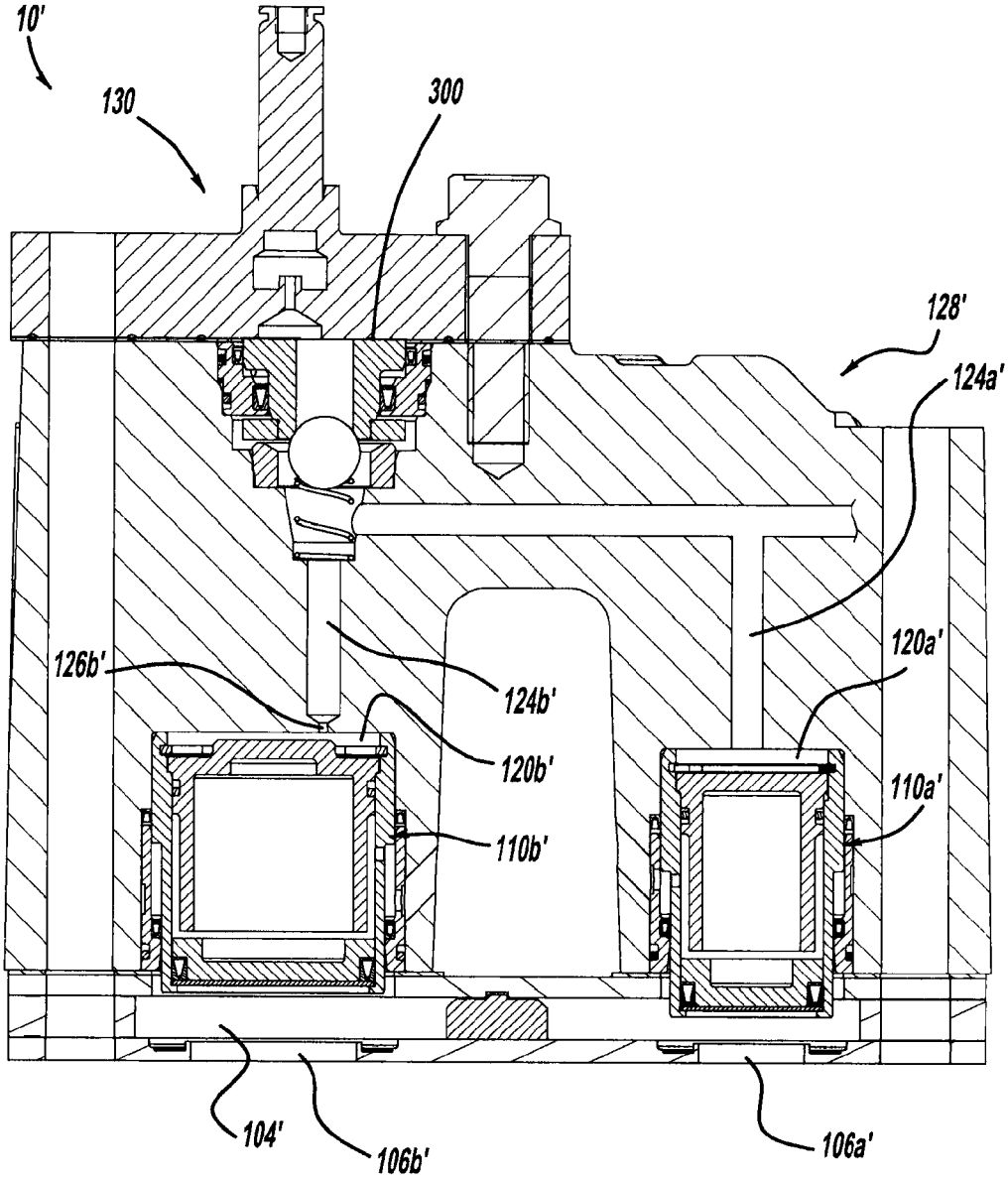
FIG. 13 is a cross-sectional view of a header showing a pair of valves having pistons of varying diameter and valve openings of varying diameter.

A specific example of a header 128' for use with a compressor 10' is provided in FIG. 13. FIG. 13 illustrates a lead piston 110*a*' and a secondary piston 110*b*' respectively associated with a chamber 120*a*' and a chamber 120*b*'. The chamber 120*a*' includes a smaller diameter when compared to chamber 120*b*' as well as a reduced length when compared to chamber 120*b*'. The reduced length of chamber 120*a*' reduces the overall travel of the piston 110*a*' within the chamber 120*a*' when compared to the overall travel of the piston 110*b*' within the chamber 120*b*'.

The piston 110*a*' is moved into the loaded position before the piston 110*b*' due to the smaller volume of the chamber 120*a*' when compared to the chamber 120*b*'. Specifically, a smaller volume of gas is required to be evacuated along a passage 124*a*' to move the piston 110*a*' from the unloaded position to the loaded position when compared to the volume of gas required to be evacuated along a passage 124*b*' to move the piston 110*b*' from the unloaded position to the loaded position. A restricted orifice 126*b*' is disposed proximate to the chamber 120*b*' along the passage 124*b*' to further reduce the flow rate of gas transferred to and evacuated from the chamber 120*b*'. As described above, the gas is either supplied to or evacuated from the chambers 120*a*', 120*b*' by energizing or de-energizing a solenoid 130 associated with the valve 300.

A valve opening 106*a*' associated with the piston 110*a*' is smaller than a valve opening 106*b*' associated with the piston 110*b*' The smaller opening prevents gas from rushing from the suction chamber 18 and into passage 104' at an excessive mass flow rate when the piston 110*a*' is moved into the loaded position in advance of the piston 110*b*'.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An apparatus comprising:

a compression mechanism;

a valve plate associated with said compression mechanism and including a plurality of ports in fluid communication with said compression mechanism;

a header disposed adjacent to said valve plate;

a plurality of cylinders disposed within said header;

a plurality of pistons respectively disposed in said plurality of cylinders and movable between a first position separated from said valve plate and permitting flow through said plurality of ports and into said compression mechanism and a second position engaging said valve plate and restricting flow through said plurality of ports and into said compression mechanism; and a chamber disposed within each of said cylinders and receiving a pressurized fluid in a first mode to move said piston into said second position and venting said pressurized fluid in a second mode to move said piston into said first position, one of said chambers including a different diameter than the other of said chambers.

2. The apparatus of claim 1, wherein said pressurized fluid is discharge-pressure gas received from said compression mechanism.

3. The apparatus of claim 1, further comprising a valve member operable to selectively supply said chamber with said pressurized fluid.

4. The apparatus of claim 1, further comprising a device restricting flow of said pressurized fluid to at least one of said chambers.

5. The apparatus of claim 4, wherein said device is a reduced-diameter orifice disposed within a passage supplying said pressurized fluid to said chambers.

6. The apparatus of claim 1, wherein each of said plurality of pistons opens in sequence.

7. The apparatus of claim 1, wherein each of said plurality of pistons opens at a different time.

8. The apparatus of claim 1, wherein one of said plurality of ports is smaller than the other of said plurality of ports.

9. A method comprising:

opening a plurality of ports of a valve plate when a plurality of pistons are in a raised position to permit flow through said plurality of ports;

evacuating fluid at a different rate from at least one of a plurality of chambers to permit one of said plurality of pistons to move into said raised position before the other of said plurality of pistons; and causing movement of said plurality of pistons within and relative to respective ones of said plurality of chambers from a lowered position to said raised position in response to evacuation of said fluid.

10. The method of claim 9, wherein said evacuating said fluid at a different rate from at least one of said plurality of chambers includes restricting flow of said fluid from said at least one of said plurality of chambers.

11. The method of claim 10, wherein said restricting flow of said fluid from said at least one of said plurality of chambers includes causing said fluid to flow through a reduced-diameter orifice.

12. The method of claim 9, wherein said causing movement of said plurality of pistons from said lowered position to said raised position includes moving said plurality of pistons from said lowered position to said raised position in sequence.

13. The method of claim 9, wherein said causing movement of said plurality of pistons from said lowered position to said raised position includes moving said plurality of pistons from said lowered position to said raised position at different times.

14. The method of claim 9, further comprising providing pressurized fluid to said plurality of chambers to move said plurality of pistons from said raised position to said lowered position.

15. The method of claim 14, wherein said providing pressurized fluid to said plurality of chambers includes actuating a valve member.

16. A method comprising:

opening a plurality of ports of a valve plate when a plurality of pistons are in a raised position to permit flow through said plurality of ports;

evacuating a reduced volume of fluid from at least one of a plurality of chambers to permit one of said plurality of pistons to move into said raised position before the other of said plurality of pistons; and causing movement of said plurality of pistons within and relative to respective ones of said plurality of chambers from a lowered position to said raised position in response to evacuation of said fluid.

17. The method of claim 16, wherein said causing movement of said plurality of pistons from said lowered position to said raised position includes causing said plurality of pistons to move from said lowered position to said raised position in sequence.

18. The method of claim 16, wherein said causing movement of said plurality of pistons from said lowered position to said raised position includes causing said plurality of pistons to move from said lowered position to said raised position at different times.

19. The method of claim 16, further comprising providing pressurized fluid to said plurality of chambers to move said plurality of pistons from said raised position to said lowered position.

20. The method of claim 16, wherein said evacuating said reduced volume of fluid from said at least one of said plurality of chambers includes evacuating fluid from a chamber having a smaller diameter than the other of said plurality of chambers.

* * * * *